US009435177B2

(12) United States Patent
Organ et al.

(10) Patent No.: US 9,435,177 B2
(45) Date of Patent: Sep. 6, 2016

(54) INTERVENTION WORKOVER CONTROL SYSTEMS

(71) Applicant: Vetco Gray Controls Limited, Nailsea (GB)

(72) Inventors: Mark Edwin Organ, Nailsea (GB); Han-Ping Liew, Nailsea (GB)

(73) Assignee: GE Oil & Gas Limited, Nailsea (GB)

( * ) Notice: Subject to any disclaimer, the term of this patent is extended or adjusted under 35 U.S.C. 154(b) by 141 days.

(21) Appl. No.: 13/951,221

(22) Filed: Jul. 25, 2013

(65) Prior Publication Data

US 2014/0027123 A1 Jan. 30, 2014

(30) Foreign Application Priority Data

Jul. 25, 2012 (EP) ..... 12177780

(51) Int. Cl.
*E21B 41/00* (2006.01)
*E21B 33/035* (2006.01)

(52) U.S. Cl.
CPC ..... *E21B 41/0007* (2013.01); *E21B 33/0355* (2013.01)

(58) Field of Classification Search
CPC ..... E21B 41/0007; E21B 33/0355; E21B 33/0385
USPC ..... 166/338, 344, 346, 349, 352, 85.1; 405/190, 191, 158, 200
See application file for complete search history.

(56) References Cited

U.S. PATENT DOCUMENTS 4,165,108 A * 8/1979 de Saint-Palais ..... 285/45
4,705,331 A 11/1987 Britton
6,102,124 A * 8/2000 Skeels et al. ..... 166/347
6,397,948 B1 * 6/2002 Williams et al. ..... 166/363
6,988,554 B2 * 1/2006 Bodine et al. ..... 166/363
2002/0040782 A1 * 4/2002 Rytlewski et al. ..... 166/341
2004/0016548 A1 * 1/2004 Barratt et al. ..... 166/346
2008/0264642 A1 10/2008 Horton
2010/0059229 A1 3/2010 Smith

FOREIGN PATENT DOCUMENTS

WO 2010021907 A2 12/2010
WO WO2010141795 A2 12/2010

OTHER PUBLICATIONS

European Search Report issued in connection with EP Application No. 12177780.9 dated Jan. 7, 2013.

* cited by examiner

*Primary Examiner* — James G Sayre
(74) *Attorney, Agent, or Firm* — GE Global Patent Operation

(57) ABSTRACT

An apparatus for use in providing an intervention workover control system for an underwater well, comprising a first structure for connecting to a hydraulic flying lead, a first support for supporting at least one electrical flying lead, a second support for supporting the hydraulic flying lead, a second structure, a third structure, and a third support for supporting the at least one electrical flying lead, the second and third structures can be connected to respective ones of opposite sides of the first structure. The structures are configured to provide an intervention workover control system of a first configuration, wherein the first structure is usable with the second and third structures connected to the first structure, and to provide an intervention workover control system of a second configuration, wherein the first structure is usable without the second and third structures connected to the first structure.

15 Claims, 2 Drawing Sheets

INTERVENTION WORKOVER CONTROL SYSTEMS

BACKGROUND OF THE INVENTION

Embodiments of the present invention relate to an apparatus for use in providing an intervention workover control system for an underwater well.

Intervention workover control systems (IWOCS) for subsea hydrocarbon wells are typically designed and manufactured to suit specific variations of applications, such as mounting on mud mats or a lower marine riser package (LMRP) and having different lengths of hydraulic flying lead (HFL).

BRIEF SUMMARY OF THE INVENTION

According to an embodiment of the present invention, there is provided an apparatus for use in providing an intervention workover control system for an underwater well. The apparatus comprises a first structure comprising an umbilical termination unit and means for connecting to a hydraulic flying lead; first support means, for use with said first structure, for supporting at least one electrical flying lead and second support means, for use with said first structure for supporting a hydraulic flying lead; and second and third structures, there being third support means, for use with at least one of said second and third structures, for supporting at least one electrical flying lead, which structures can be connected to respective ones of opposite sides of said first structure, wherein said first, second and third structures are adapted so that: to provide an intervention workover control system of a first configuration, said first structure is usable with said second and third structures connected to respective ones of opposite sides of said first structure; and to provide an intervention workover control system of a second configuration, said first structure is usable without said second and third structures connected to it.

According to an embodiment of the present invention, a fourth support means is provided, for use with said second and third structures, for use in supporting such a hydraulic flying lead in an intervention workover control system of said first configuration.

According to an embodiment of the present invention, the apparatus is adapted so that such a hydraulic flying lead is supported by said second support means in an intervention workover control system of said second configuration.

According to an embodiment of the present invention, the apparatus is adapted so that at least one such electrical flying lead is supported by said third support means in an intervention workover control system of said first configuration.

According to an embodiment of the present invention, the apparatus is adapted so that at least one such electrical flying lead is supported by said first support means in an intervention control system of said second configuration.

According to an embodiment of the present invention, each of said second and third structures could be provided with means for engaging with an upright member located on or for location on a bed of a body of water, for supporting an intervention workover control system of said first configuration. Such engaging means could be generally tubular.

According to an embodiment of the present invention, said first structure could include means for engaging with an upright member, for supporting an intervention control system of said second configuration.

According to an embodiment of the present invention, the apparatus could include at least one further structure, providing a parking position for equipment and for attachment to one of said second and third structures in an intervention workover control system of said first configuration or to said first structure in an intervention workover control system of said second configuration.

According to an embodiment of the present invention, the apparatus could include at least one further structure for carrying further equipment and for attachment to one of said second and third structures in an intervention workover control system of said first configuration or to said first structure in an intervention workover control system of said second configuration.

According to an embodiment of the present invention, the apparatus could include at least one further structure, providing a parking position for equipment and for attachment to one of said second and third structures in an intervention workover control system of said first configuration or to said first structure in an intervention workover control system of said second configuration; and at least one further structure, for carrying further equipment and for attachment to the other of said second and third structures in an intervention workover control system of said first configuration or to said first structure in an intervention workover control system of said second configuration.

According to an embodiment of the present invention, such further equipment could comprise at least one of hydraulic gauges and remotely operated vehicle (ROV) connections and ROV-operated valves.

According to an embodiment of the present invention, there is provided a method of providing an intervention workover control system for an underwater well. The method comprising the steps of providing apparatus according to the invention and using the apparatus to form a system according to the first or second configuration.

According to an embodiment of the present invention, where the intervention workover control system is of the first configuration it could be located on a mud mat on a bed of a body of water.

According to an embodiment of the present invention, where the intervention workover control system is of the second configuration it could be located on a lower marine riser package.

DETAILED DESCRIPTION OF THE EXEMPLARY EMBODIMENTS OF THE INVENTION

Figure 1:
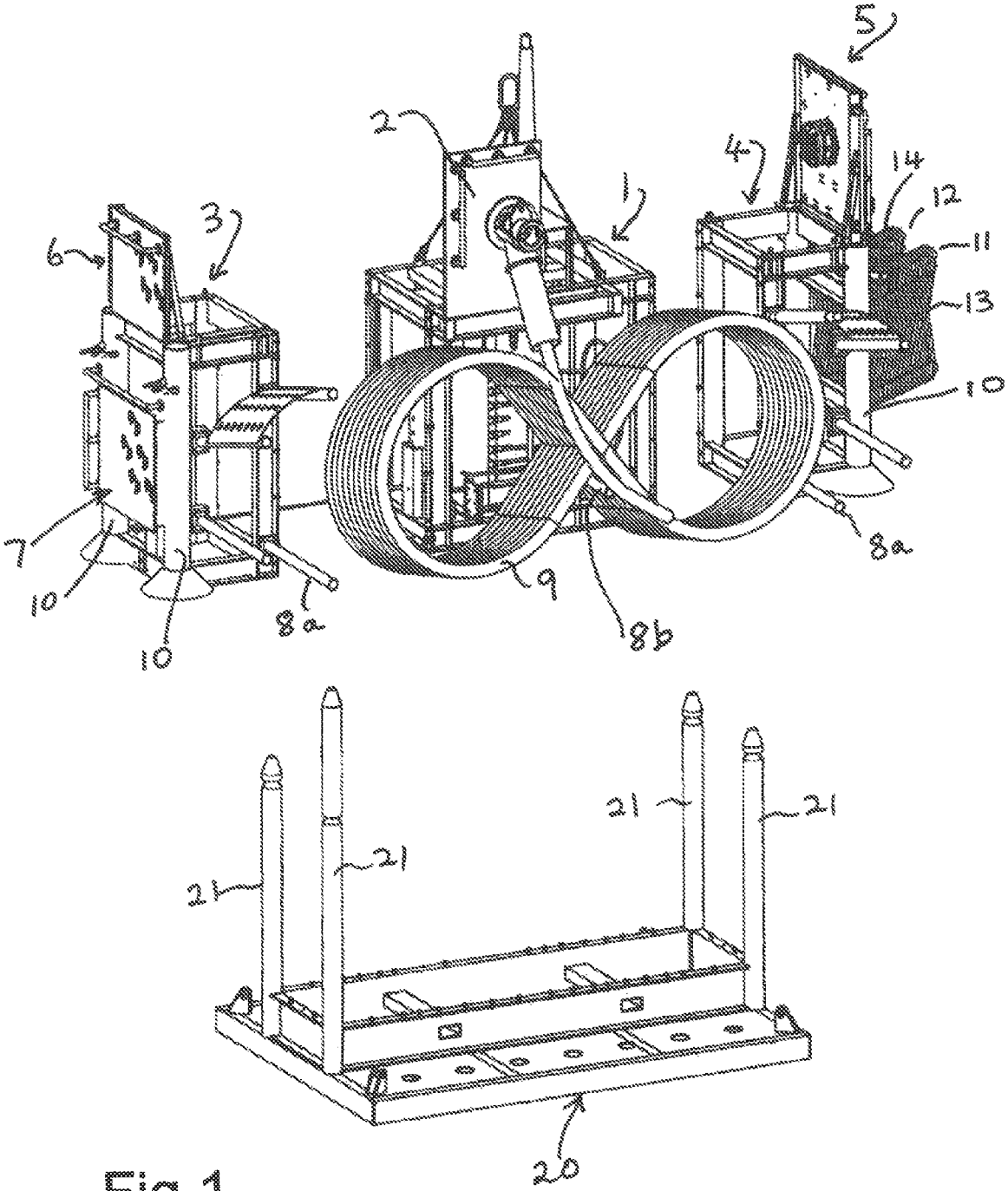
FIG. 1 shows parts of apparatus according to an embodiment of the present invention before assembly in an IWOCS of a first configuration.

The following describes the use of apparatus according to an embodiment of the invention to provide two different IWOCS configurations—that is a first configuration (see FIG. 1) in which parts of the apparatus provide an IWOCS on a mud mat on the seabed and a second configuration (see FIG. 2) in which parts of the apparatus provide an IWOCS on a LMRP.

According to an embodiment of the present invention, the overall apparatus comprises: a first modular structure in the form of a subsea umbilical termination unit (SUTU) 1 having a plate 2 providing a parking (and flushing) position for a HFL; second and third modular structures 3 and 4; a further structure 5 (providing a parking plate during intervention workover for a hydraulic stabplate long-term protective cover of a subsea tree); and further structures 6 and 7 comprising ROV intervention panels carrying hydraulic gauges and ROV-operated valves.

According to an embodiment of the present invention, each of structures 3 and 4 carries supports comprising four posts 8*a* around which a lengthy HFL 9 can be wound in a "figure of eight" in the first configuration. In an embodiment, the length of such a HFL could be 40 to 80 meters. When used in the first configuration, the structure 1 is fitted with a post 8*b* for use in supporting such a HFL. For use in the first configuration, each of structures 3 and 4 also carries two conically-ended guide funnels 10 and structure 4 carries support posts 11 and 12 around which lengthy electric flying leads (EFLs) 13 and 14 can be wound. When used in the second configuration but not the first, SUTU 1 is fitted, for example, with projections or supports 23 (shown in FIG. 2) around which relatively short EFLs 15 and 16 can be wound and support projections at 17 and 18 for a relatively short HFL 19 (typically 20 to 40 meters long). Also, inside SUTU 1 there is a guide passageway for engagement with a post attached to a LMRP in the second configuration.

FIG. 1 shows parts of the apparatus before assembly in an IWOCS configuration suited for mounting on a mud mat 20 on the seabed.

The structures 3 and 4 are mated with SUTU 1 so that they are attached on respective sides of SUTU 1, with structure 5 attached to the side of structure 4 remote from SUTU 1 and structures 6 and 7 attached to structure 3 on sides remote from SUTU 1. Since the IWOCS is to be mounted on mud mat 20, the HFL 9 is a relatively long one and is supported by posts 8*a*, around which it is wound in a "figure of eight" shape, and post 8*b* and relatively long EFLs 13 and 14 are used. The IWOCS assembly thereby formed can either be lowered by a ROV on to mud mat 20 on the seabed with guide posts 21 on the mud mat engaging with and passing through respective ones of guide funnels 10. Alternatively, the IWOCS assembly can be mounted on to the mud mat 20 before lowering to the seabed, using a ROV with through-pin mechanisms which pass through openings in the guide posts 21 and the guide funnels 10 to hold the IWOCS assembly and the mud mat 20 together as they are lowered to the seabed.

Figure 2:
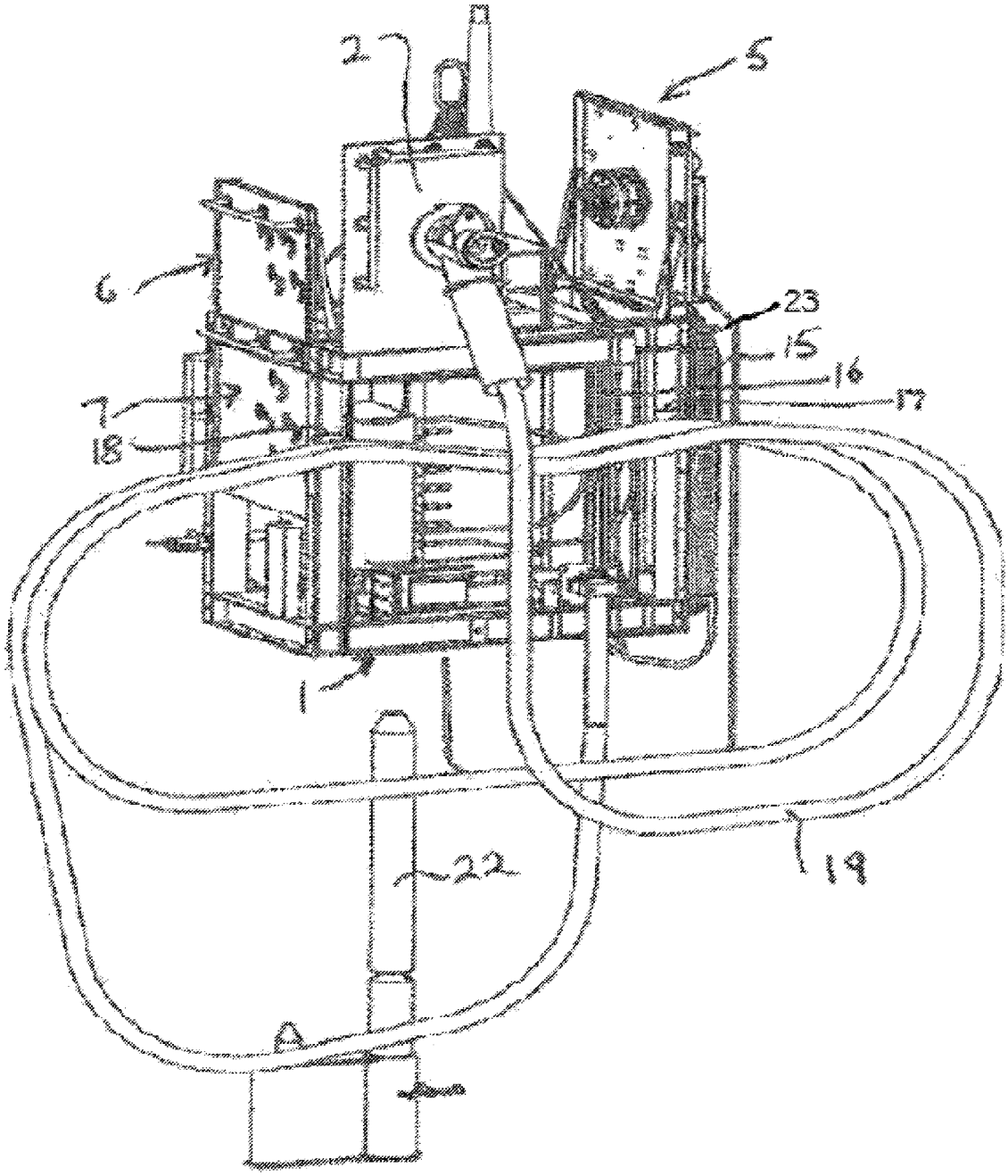
FIG. 2 shows parts of an apparatus according to an embodiment of the present invention before assembly in an IWOCS of a second configuration.

FIG. 2 shows parts of the apparatus before assembly in an IWOCS configuration suited for mounting on a post 22 attached to a LMRP, a so-called "LMRP mono-post". The post 22 is mounted on a flange that is attached, for example by welding, on to a LMRP. Relatively short EFLs 15 and 16 and a relatively short HFL 19 supported by the projections at 17 and 18 are used but the structures 3 and 4 are not used, structure 5 being attached to one side of SUTU 1 and structures 6 and 7 being attached to the opposite side of SUTU 1. The IWOCS assembly thus formed is lowered using a ROV on to the post 22, the latter engaging and passing through the guide passageway provided inside the SUTU 1, so that the assembly lands on top of the LMRP.

An embodiment of the present invention has the advantage that the need for field-specific forms of IWOCS is avoided by providing apparatus which can be used to provide the necessary parts for different configurations and the same termination unit can be used in them.

An embodiment of the present invention enables a flexible alternative with a modular approach, requiring minimal engineering to meet a wide range of applications.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An apparatus for use in providing an intervention workover control system for an underwater well, the apparatus comprising:

a first structure comprising an umbilical termination unit and a connector configured to connect the first structure to a hydraulic flying lead;

at least one support configured to support the hydraulic flying lead, wherein the at least one support comprises a first support for use with the first structure, wherein the first support supports the hydraulic flying lead;

at least one support configured to support at least one electrical flying lead;

a second structure connected to a first side of the first structure; and a third structure connected to a second side, opposite to the first side, of the first structure, wherein the first structure, the second structure, and the third structure are modular parts configured to provide for at least two configurations of the intervention workover control system, wherein:

in a first configuration, the first structure is usable with the second structure and the third structure connected to one of the first side and the second side of the first structure, and in a second configuration, the first structure is usable without connecting the second structure and the third structure to the first structure.

2. The apparatus according to claim 1, wherein the at least one support configured to support the hydraulic flying lead in the first configuration further comprises a second support for use with the second structure and the third structure, wherein the second support supports the hydraulic flying lead.

3. The apparatus according to claim 1, wherein the at least one support configured to support the at least one electrical flying lead in the first configuration comprises a third support for use with the second structure and the third structure, wherein the third support supports the at least one electrical flying lead.

4. The apparatus according to claim 1, wherein the at least one support configured to support the at least one electrical flying lead in the second configuration further comprises a fourth support or projection for use with the first structure, wherein the fourth support or projection supports the at least one electrical flying lead.

5. The apparatus according to claim 1, wherein in the first configuration, each of the second structure and the third structure is provided with an engaging mechanism configured to engage the respective structure with an upright member located on a bed of a body of water, for supporting the intervention workover control system of the first configuration.

6. The apparatus according to claim 5, wherein the engaging mechanism is tubular.

7. The apparatus according to claim 1, wherein in the second configuration, the first structure further comprises an engaging mechanism configured to engage the first structure with an upright member, for supporting the intervention workover control system of the second configuration.

8. The apparatus according to claim 1, further comprising at least one further structure configured to provide a parking position for equipment and is attached to one of the second structure and the third structure in the intervention workover control system of the first configuration or to the first structure in the intervention workover control system of the second configuration.

9. The apparatus according to claim 1, further comprising at least one further structure configured to carry further equipment and is attached to one of the second structure and the third structure in the intervention workover control system of the first configuration or to the first structure in the intervention workover control system of the second configuration.

10. The apparatus according to claim 9, wherein the further equipment comprises at least one of hydraulic, gauges, ROV connections and ROV-operated valves.

11. The apparatus according to claim 1, further comprising:

at least one further structure configured to provide a parking position for equipment and is attached to one of the second structure and the third structure in the intervention workover control system of the first configuration or to the first structure in the intervention workover control system of the second configuration; and at least one further structure configured to carry further equipment and is attached to the other of the second structure and the third structure in the intervention workover control system of the first configuration or to the first structure in the intervention workover control system of the second configuration.

12. The apparatus according to claim 11, wherein the further equipment comprises at least one of hydraulic gauges, ROV connections and ROV-operated valves.

13. A method of providing an intervention workover control system for an underwater well, the method comprising:

providing an apparatus comprising:

a first structure comprising an umbilical termination unit and a connector configured to connect the first structure to a hydraulic flying lead;

at least one support configured to support the hydraulic flying lead, wherein the at least one support comprises a first support for use with the first structure, wherein the first support supports the hydraulic flying lead;

at least one support configured to support at least one electrical flying lead;

a second structure connected to a first side of the first structure;

a third structure connected to a second side, opposite to the first side, of the first structure; and wherein the first structure, the second structure, and the third structure are modular parts configured to provide for at least two configurations of the intervention workover control system, wherein:

in a first configuration, the first structure is usable with the second structure and the third structure connected to one of the first side and the second side of the first structure, and in a second configuration, the first structure is usable without connecting the second structure and the third structure to the first structure; and using the apparatus to form the intervention workover control system according to the first configuration or the second configuration.

14. The method according to claim 13, wherein the intervention workover control system is of the first configuration and is located on a mud mat on a bed of a body of water.

15. The method according to claim 13, wherein the intervention workover control system is of the second configuration and is located on a lower marine riser package.

* * * * *